United States Patent [19]

Higginson

[11] 4,411,643

[45] Oct. 25, 1983

[54] DOUBLE ENVELOPE AND METHOD OF MAKING SAME

[75] Inventor: Richard L. Higginson, Mahwah, N.J.

[73] Assignee: Berlin & Jones Company, Inc., East Rutherford, N.J.

[21] Appl. No.: 233,167

[22] Filed: Feb. 10, 1981

[51] Int. Cl.[3] ..... B31B 41/00

[52] U.S. Cl. ..... 493/188; 229/73; 493/216; 493/263; 493/265; 493/921

[58] Field of Search ..... 493/216, 921, 922, 254, 493/263, 262, 261, 260, 265, 264, 188; 229/73

[56] References Cited

U.S. PATENT DOCUMENTS

| | | | |
|---|---|---|---|
| 3,167,243 | 1/1965 | Wiley | 229/73 |
| 3,184,150 | 5/1965 | Hubbard | 229/73 |
| 3,531,046 | 9/1970 | Carrigan | 229/73 X |
| 3,618,284 | 11/1971 | Gendron | 493/216 X |
| 3,897,720 | 8/1975 | Hiersteiner | 493/216 |
| 3,946,938 | 3/1976 | Kranz | 229/73 |
| 4,031,818 | 6/1977 | Kehoe | 493/254 X |

*Primary Examiner*—James F. Coan

*Attorney, Agent, or Firm*—Robert E. Burns; Emmanuel J. Lobato; Bruce L. Adams

[57] ABSTRACT

A double envelope construction comprised of one envelope inside another envelope is formed in one pass on an envelope folding machine by providing a pre-cut envelope blank and a paper blank of smaller size than the envelope blank, adhering the paper blank to the envelope blank by means of fugitive adhesive, applying remoistenable seal gum to the flap portion of the envelope blank, drying the seal gum, and scoring the adhered together envelope and paper blanks at predetermined locations and folding the scored blanks while applying adhesive to predetermined areas thereof to form an outer envelope from the envelope blank and an inner envelope inside the outer envelope from the paper blank. The envelope blank or the paper blank, or both, may be preprinted prior to being fed to the envelope folding machine or may be printed by a printer in-line with the envelope folding machine.

16 Claims, 13 Drawing Figures

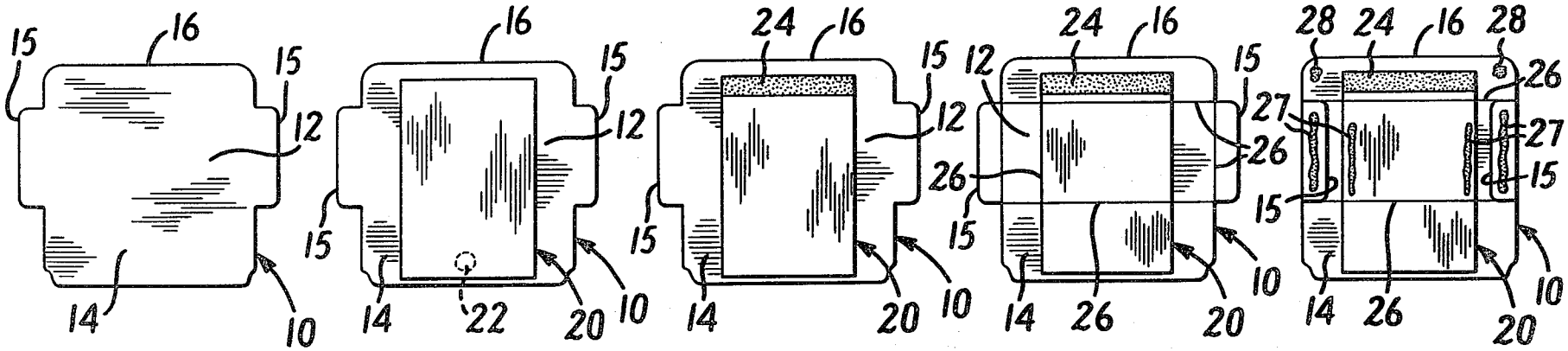
FIG. 1
FIG. 2
FIG. 3
FIG. 4
FIG. 5
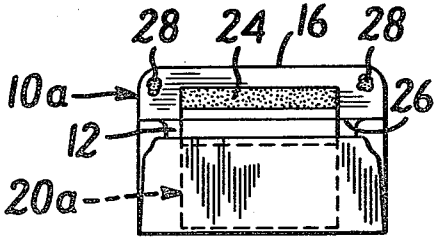
FIG. 6
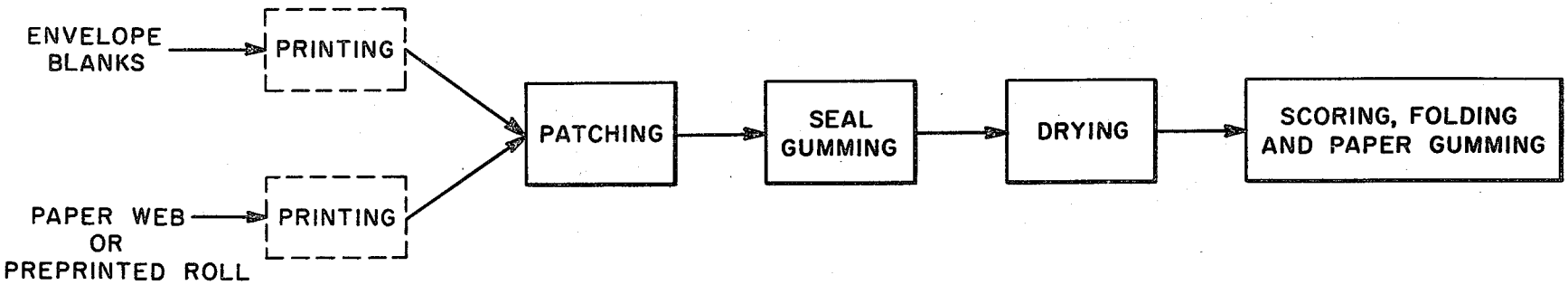
FIG. 7

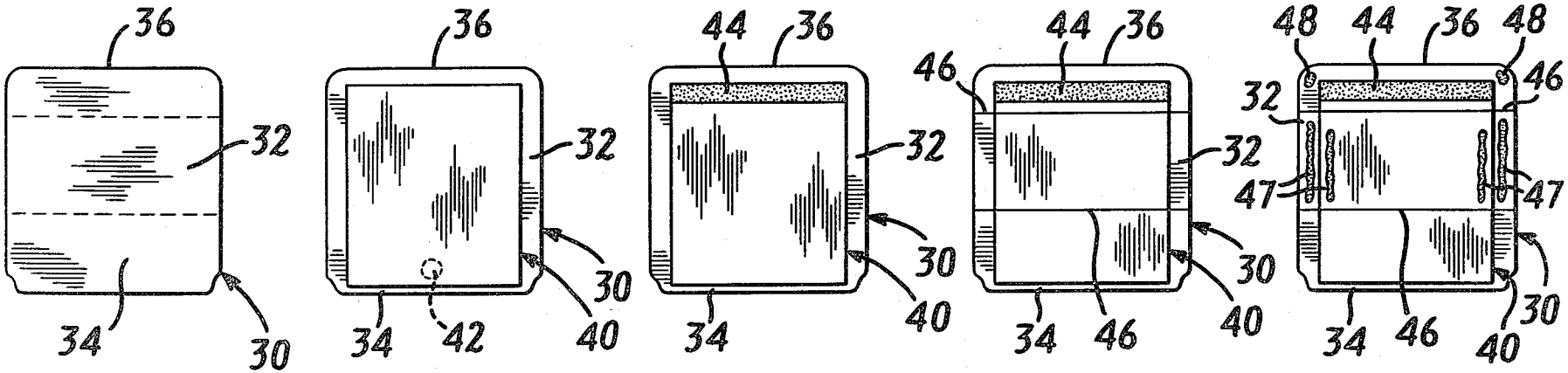
FIG. 8
FIG. 9
FIG. 10
FIG. 11
FIG. 12
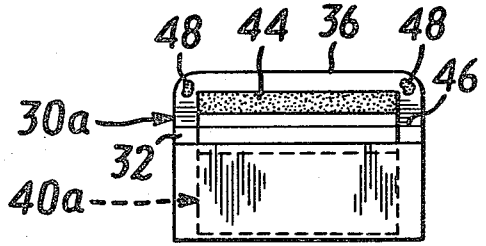
FIG. 13

DOUBLE ENVELOPE AND METHOD OF MAKING SAME

BACKGROUND OF THE INVENTION

The present invention pertains generally to double envelope constructions and more particularly to double envelope constructions comprised of two envelopes, one inside the other, formed in one pass on an envelope folding machine.

Double envelopes have become quite popular and are commonly used to send material to addressees in the outer envelope and to enable the addressees to return material to the sender in the inner envelope. In such case, the inner envelope is usually preprinted with the address of the sender. Double envelopes are also used to send material to addressees some of which, such as documents, tickets, stamps, coupons and the like, is contained in the inner envelope.

Double envelope constructions in use today are generally made by separately forming the inner and outer envelopes and then inserting the inner one into the outer one. The separate manufacture of the two envelopes as well as the required step of inserting the inner envelope into the outer one increase considerably the cost of manufacturing the double envelopes.

SUMMARY OF THE INVENTION

It is, therefore, one object of the present invention to provide a method of manufacturing double envelopes which overcomes the drawbacks of prior art methods.

Another object of the present invention is to provide a method of making double envelopes in one pass on an envelope folding machine.

A further object of the present invention is to provide a method of making double envelopes by converting standard envelope folding machines, either with or without a web attachment, to enable them to manufacture double envelopes.

A still further object of the present invention is to provide a double envelope made according to the method of the invention.

The above and other objects of the invention are achieved by providing a pre-cut envelope blank and a paper blank of smaller size than the envelope blank, adhering the paper blank to the envelope blank by means of fugitive adhesive, applying remoistenable seal gum to the upper edge portion of the paper blank, drying the seal gum, and scoring the adhered together envelope and paper blanks at predetermined locations and folding the scored blanks while applying adhesive to predetermined areas thereof to form an outer envelope from the envelope blank and an inner envelope inside the outer envelope from the paper blank. The envelope blank or the paper blank, or both, may be preprinted prior to being fed to the envelope folding machine or may be printed by a printer in-line with the envelope folding machine.

Having in mind the above objects as well as other objects of the invention which will become apparent from a reading of this disclosure, the present invention comprises the method of making double envelopes and the double envelopes made by the method as illustrated in the presently preferred embodiments which are hereinafter set forth in sufficient detail to enable those persons ordinarily skilled in the art to clearly understand the manner of carrying out the invention when read in conjunction with the accompanying drawings.

BRIEF DESCRIPTION OF THE DRAWINGS

FIG. 1 is an explanatory plan view of an exemplary type envelope blank which can be used in carrying out the method of the invention;

FIG. 2 is an explanatory plan view showing the envelope blank with a paper blank attached thereto;

FIG. 3 is an explanatory plan view of the envelope and paper blanks after the application of seal gum;

FIG. 4 is an explanatory plan view of the envelope and paper blanks after the application of score lines;

FIG. 5 is an explanatory plan view of the envelope and paper blanks after folding over the envelope blank seams and after the application of paper gum;

FIG. 6 is an explanatory plan view of the double envelope construction formed by folding the envelope and paper blanks along the score lines shown in FIG. 5;

FIG. 7 is a block diagram showing the sequence of steps carried out on the envelope folding machine in accordance with the method of the invention; and FIGS. 8–13 are explanatory plan views corresponding to FIGS. 1–6 and showing the steps of forming a double envelope using an envelope blank without seam portions.

DETAILED DESCRIPTION OF PREFERRED EMBODIMENTS OF THE INVENTION

The method of the present invention can be carried out on conventional envelope folding machines having what is known in the art as window equipment which is used to cut one or more windows in an envelope and cover the windows with transparent material during a single pass of the envelope blank through the machine. Such window envelope folding machines have a patching station where the transparent material is adhered to the envelope by adhesive in such manner as to cover the cut-out windows. By way of example, machines manufactured by F. L. Smithe under model designations Smithe RA, EWC, CF3, CF4 and MO and machines manufactured by Winkler & Dunnebier under model designations 327GSR and 527 and similar type machines made by other manufacturers can be used to carry out the method of the invention. As these machines and their construction and mode of operation are well known to those skilled in the art, and as the machine constructions do not comprise any part of the present invention, no detailed description thereof is necessary to enable a ready understanding of this disclosure.

Referring to the drawings, FIGS. 1–6 show the various states of the blanks as they travel through the envelope forming machine according to the method of the invention which is shown in block form in FIG. 7. The inventive method can be carried out on envelope folding machines with or without a web attachment and by way of illustration, the method will be described with reference to both types of machines. In the case of an envelope folding machine with a web attachment, a paper web (which will form the inner envelopes) is mounted on the machine and pre-cut envelope blanks (which will form the outer envelopes) are supplied to a blank feed station of the machine. During operation of the machine, the paper web is cut into a succession of paper blanks which are fed to a patching station in synchronization with the feeding of a succession of envelope blanks to the patching station.

The envelope blanks and/or the paper web may be suitably printed with any desired information by means of an in-line printer. Alternatively, the envelope blanks and paper web may be preprinted or, depending on the needs of the customer, no printing may be desired.

The envelope blanks are formed of standard stock and may be of any desired envelope shape. FIG. 1 shows a typical envelope blank 10 having major face and back portions 12 and 14, respectively, two seam portions 15 at opposite ends of the face portion 12, and a flap portion 16 extending along the length of the face portion 12. The envelope blanks 10 are usually formed by die-cutting as well known in the art.

The envelope blanks 10 are successively fed to the patching station in synchronization with the feeding of the paper blanks cut from the paper web. At the patching station, the paper blank 20 overlies the envelope blank 10 in superposed relationship as shown in FIG. 2. The paper blank 20, in the embodiment shown, has a generally rectangular shape and overlies part of the flap 16, face 12 and back 14 portions of the envelope blank 10. The paper blank 20 does not, however, overlie the two seam portions 15 of the envelope blank 10. At the patching station, the paper blank 20 is patched or adhered to the envelope blank 10 by means of fugitive gum adhesive 22 which, in the embodiment shown, is applied at one spot at the back portion 14 of the envelope blank. The envelope and paper blanks are adhered together by fugitive gum adhesive to ensure that the two blanks travel in unison through the machine in predetermined alignment with one another. The fugitive gum adhesive has sufficient adhesive quality to hold together the two blanks for anywhere from several hours to a couple of days and thereafter the adhesive disintegrates so as to permit ready removal of the inner envelope from the outer envelope.

The adhered together envelope and paper blanks are then transported to a seal gum applicator where remoistenable seal gum adhesive 24 is applied to the upper edge portion of the paper blank 20 which will ultimately form the flap portion of the inner envelope. The state of the envelope and paper blanks after seal gumming is shown in FIG. 3. According to the invention, remoistenable seal gum can also be applied to the flap portion 16 of the envelope blank 10 at the same time it is applied to the upper edge portion of the paper blank 20 to enable sealing of the outer envelope or, as will be described hereinafter, paper-to-paper adhesive can be applied to the flap portion 16 to seal the outer envelope.

After application of the seal gum adhesive, the envelope and paper blanks are transported through a dryer section of the machine in order to dry the seal gum. Usually the drying is done by infrared heaters mounted along the length of the machine.

The dried envelope and paper blanks are then fed to the folding section of the machine where the blanks are scored, folded and paper-gummed to form the double envelope construction. As shown in FIG. 4, suitable score lines 26 are applied to the blanks and after scoring, the two seam portions 15 of the envelope blank 10 are folded over along the score lines 26 as shown in FIG. 5. Paper-to-paper gum adhesive 27 is applied along the outer exposed areas of the folded-over seam portions 15 and along the two marginal edge portions of that part of the paper blank 20 which overlies the envelope blank face portion 12. Paper-to-paper gum adhesive is also applied to the envelope blank flap portion 16 and in the embodiment shown, the adhesive is applied at two spots 28 at the two corners of the flap portion 16. The envelope blank back portion 14 is then folded over along the score line 26 and due to the adherence of the paper blank 20 to the envelope blank 10, that part of the paper blank which overlies the back portion 14 is simultaneously folded over with the folding over of the back portion 14. The folded-over envelope blank back portion 14 adheres to the seam portions 15 due to the paper gum adhesive 27 thereby forming the outer envelope **10*a* and in like manner, the marginal edge portions of the paper blank 20 which overlie the face and back portions of the envelope blank 10 adhere together due to the adhesive 27 thereby forming the inner envelope 20*a*. This state of the double envelope construction is shown in FIG. 6. The flap portion 16 is then folded over along the score line 26 whereby the gum adhesive spots 28 adhere the flap portion 16 to the folded-over back portion 14 thereby sealing closed the outer envelope 10*a*. In the case where remoistenable seal gum is applied to the flap portion of the envelope blank 10 instead of the gum spots 28, the remoistenable seal gum is moistened before the flap portion 16 is folded over in order to seal closed the outer envelope 10*a***.

In the case of an envelope folding machine without a web attachment, a preprinted paper roll (which will form the inner envelopes) is mounted on the machine at the patching station and the paper roll is fed onto the patching carrier and cut into a succession of paper blanks. The feeding of the paper blanks is synchronized with the feeding of the envelope blanks in a manner well known in the art and the succession of paper blanks are placed in superposed relationship with respect to the succession of envelope blanks and the superposed blanks are patched or adhered together by fugitive adhesive as shown in FIG. 2. In other respects, the method is like that described above with respect to the envelope folding machine with a web attachment.

The embodiment of the invention shown in FIGS. 8–13 pertains to the method of making a double envelope construction using an envelope blank which does not have seam portions. FIG. 8 shows an exemplary envelope blank 30 without seam portions and having a face portion 32, a back portion 34 and a flap portion 36. The three envelope blank portions are shown in the drawing as being separated by dashed lines which have been added for the sole purpose of distinguishing the several envelope blank portions and the dashed lines are not intended to designate any structural characteristic of the envelope blank 30. The envelope blanks 30 are successively fed to the patching station of the envelope folding machine synchronously with the feeding of paper blanks which may be cut from a paper web or a preprinted paper roll. At the patching station, a paper blank 40 is placed in superposed overlying relationship with the envelope blank 30 and the two blanks are patched or adhered together by fugitive gum adhesive 42 as shown in FIG. 9.

The adhered together envelope and paper blanks are then transported to a seal gum applicator for application of remoistenable seal gum adhesive 44 to the upper edge portion of the paper blank 40. If desired, remoistenable seal gum adhesive can also be applied to the flap portion 36 of the envelope blank 30 to enable subsequent sealing of the outer envelope which will be formed from the envelope blank 30 though according to the embodiment shown in the drawings, other means are employed to seal closed the outer envelope. FIG. 10 shows the state of the envelope and paper blanks after seal gumming.

The envelope and paper blanks are then transported through a dryer section of the machine to dry the seal gum adhesive 44.

The dried envelope and paper blanks are then fed to the folding section of the machine where, as shown in FIG. 11, the blanks are scored with suitable score lines 46 at predetermined locations where the blanks are to be folded. After scoring, paper-to-paper gum adhesive 47 is applied along the two marginal edge portions of the envelope blank face portion 32 and along the two marginal edge portions of that part of the paper blank 40 which overlies the envelope blank face portion 32. At the same time, paper-to-paper gum adhesive is also applied to the flap portion 36 of the envelope blank 30 and as shown in FIG. 12, in the disclosed embodiment the adhesive is applied at two spots 48 located at the two corners of the envelope blank flap portion 36. The envelope blank back portion 34 and that part of the paper blank 40 which overlies the back portion 34 are then folded along the score line 46 so that the adhesive 47 adheres the folded-over envelope blank back portion 34 to the face portion 32 thereby forming the outer envelope 30*a* and the adhesive adheres the marginal edge portions of the paper blank 40 which overlie the face and back portions of the envelope blank thereby forming the inner envelope 40*a*. FIG. 13 shows the double envelope construction formed in this fashion. The flap portion 36 of the outer envelope 30*a* is then folded over along the score line 46 so that the gum adhesive spots 48 adhere the flap portion 36 to the folded-over back portion 34 thereby sealing closed the outer envelope 30*a*.

One advantage of the embodiment shown in FIGS. 8–13 over the embodiment shown in FIGS. 1–6 is that inner envelopes of larger size can be made for the same size outer envelope when the outer envelope blank does not have seam portions. This is apparent from a comparison of the inner envelope 40*a* shown in FIG. 13 with the inner envelope 20*a* shown in FIG. 6. Another advantage is that one folding step can be eliminated during manufacture of the double envelopes if the outer envelope blanks do not have seam portions thereby enabling increased production speed.

Thus in accordance with the present invention, an envelope folding machine with a web attachment is converted to produce double envelopes by feeding a paper web to the patching station and cutting the paper web into successive paper blanks which are attached to respective ones of the envelope blanks at the patching station by fugitive adhesive so that as the envelope blank is seal-gummed, scored, folded and paper-gummed to form the outer envelope, the paper blank is similarly processed at the same time to form the inner envelope inside the outer envelope. In the case of an envelope folding machine which does not have a web attachment, the same method can be carried out by mounting a preprinted paper roll on the machine at the patching station and cutting the paper roll into a succession of paper blanks which are adbered to respective ones of the envelope blanks at the patching station so that as the envelope blanks are formed into envelopes, the paper blanks are simultaneously formed into inner envelopes inside respective ones of the outer envelopes.

Obvious changes and modifications will become apparent to those skilled in the art and the present invention is intended to cover all such modifications and changes falling within the spirit and scope of the invention as defined in the appended claims.

I claim:

1. A method of making a double envelope comprised of one envelope inside another envelope in one pass on an envelope folding machine, said method comprising the steps of:

providing a pre-cut envelope blank foldable into an envelope and a paper blank of smaller size than the envelope blank;

adhering the paper blank to the envelope blank in superposed relationship with fugitive adhesive;

applying remoistenable seal gum to the upper edge portion of the paper blank adhered to the envelope blank;

drying the seal gum; and scoring the adhered together envelope and paper blanks at predetermined locations, and folding the scored blanks and applying adhesive to predetermined areas of the scored blanks to form an outer envelope from said envelope blank and an inner envelope inside said outer envelope from said paper blank.

2. A method according to claim 1; wherein said providing step comprises providing an envelope blank having adjacent face and back portions, two seam portions at opposite ends of the face portion, and a flap portion extending along the face portion, and providing a paper blank having a generally rectangular shape; and said adhering step comprises adhering the paper blank to the envelope blank such that the paper blank overlies part of said flap, face and back portions but not said two seam portions of said envelope blank.

3. A method according to claim 2; wherein said scoring, folding and applying step comprises folding over the two envelope blank seam portions toward said paper blank, applying adhesive along outer exposed areas of the folded-over seam portions and along the two marginal edge portions of that part of the paper blank which overlies the envelope blank face portion, and then simultaneously folding over the envelope blank back portion and that part of the paper blank which overlies said back portion toward the folded-over seam portions to both adhere said back portion to said seam portions thereby forming the outer envelope and adhere the marginal edge portions of said part of the paper blank overlying the envelope blank face portion to said part of the paper blank overlying the envelope blank back portion thereby forming the inner envelope inside said one envelope.

4. A method according to claim 3; wherein said step of applying seal gum comprises applying remoistenable seal gum to the flap portion of the envelope blank and to a portion of the paper blank which overlies said flap portion.

5. A method according to claim 3 or 4; wherein said adhering step comprises adhering the paper blank to the back portion of the envelope blank.

6. A method according to claim 3 or 4; wherein said providing step comprises feeding a succession of envelope blanks, and feeding a succession of paper blanks cut from a paper web in synchronization with the feeding of the envelope blanks.

7. A method according to claim 6; further including printing information on at least one of said succession of envelope blanks and said succession of paper blanks.

8. A method according to claim 3 or 4; wherein said providing step comprises feeding a succession of envelope blanks, and feeding a succession of paper blanks cut from a preprinted paper roll in synchronization with the feeding of the envelope blanks.

9. A method according to claim 1; wherein said providing step comprises providing an envelope blank having adjacent face and back portions, and a flap portion extending along the face portion, and providing a paper blank having a generally rectangular shape; and said adhering step comprises adhering the paper blank to the envelope blank such that the paper blank overlies the central portion but not the two sides edge portions of said flap, face and back portions of said envelope blank.

10. A method according to claim 9; wherein said scoring, folding and applying step comprises applying adhesive along the two marginal side edge portions of the envelope blank face portion and along the two marginal edge portions of that part of the paper blank which overlies the envelope blank face portion, and then simultaneously folding over the envelope blank back portion and that part of the paper blank which overlies said back portion to both adhere the marginal side edge portions of said back portion to said face portion thereby forming the outer envelope and adhere the marginal edge portions of said part of the paper blank overlying the envelope blank face portion to said part of the paper blank overlying the envelope blank back portion thereby forming the inner envelope inside said one envelope.

11. A method according to claim 10; wherein said step of applying seal gum comprises applying remoistenable seal gum to the flap portion of the envelope blank and to a portion of the paper blank which overlies said flap portion.

12. A method according to claim 10 or 11; wherein said adhering step comprises adhering the paper blank to the back portion of the envelope blank.

13. A method according to claim 10 or 11; wherein said providing step comprises feeding a succession of envelope blanks, and feeding a succession of paper blanks cut from a paper web in synchronization with the feeding of the envelope blanks.

14. A method according to claim 13; further including printing information on at least one of said succession of envelope blanks and said succession of paper blanks.

15. A method according to claim 10 or 11; wherein said providing step comprises feeding a succession of envelope blanks, and feeding a succession of paper blanks cut from a preprinted paper roll in synchronization with the feeding of the envelope blanks.

16. A double envelope comprised of one envelope inside another envelope made according to the method of claim 1, 2, 3, 4, 9, 10 or 11.

* * * * *